US006634968B2

(12) United States Patent
Yeh

(10) Patent No.: US 6,634,968 B2
(45) **Date of Patent: *Oct. 21, 2003**

(54) STRING FOR A RACKET

(76) Inventor: Peter Yeh, No. 52, Sec. 5, Lu-Ho Rd., Ho-Mei chen, Chang-Hua Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/877,485

(22) Filed: Jun. 8, 2001

(65) Prior Publication Data

US 2002/0039938 A1 Apr. 4, 2002

Related U.S. Application Data

(63) Continuation-in-part of application No. 09/676,404, filed on Sep. 29, 2000, now Pat. No. 6,450,904.

(51) Int. Cl.[7] ..... A63B 49/00; A63B 51/02
(52) U.S. Cl. ..... 473/543; 473/524
(58) Field of Search ..... 473/524, 543; 428/373; 57/230, 210, 224, 225, 236, 243

(56) References Cited

U.S. PATENT DOCUMENTS 4,275,117 A * 6/1981 Crandall ..... 156/148
4,339,499 A * 7/1982 Tappe et al. ..... 264/210.7
4,860,531 A * 8/1989 Wells et al. ..... 57/232
4,956,236 A * 9/1990 Wang ..... 428/373
5,090,188 A * 2/1992 Lin et al. ..... 57/232
5,327,714 A * 7/1994 Stevens et al. ..... 273/DIG. 6
5,922,462 A * 7/1999 Kent et al. ..... 428/373
6,009,699 A * 1/2000 Delvael ..... 57/210

FOREIGN PATENT DOCUMENTS

EP 257424 * 3/1988 ..... A63B/51/00
EP 377362 * 7/1990 ..... 473/FOR 171

* cited by examiner

*Primary Examiner*—Raleigh W. Chiu
(74) *Attorney, Agent, or Firm*—Townsend and Townsend and Crew, LLP

(57) ABSTRACT

A string for a sports racket includes a base core formed from at least a first filament, an intermediate layer formed from a plurality of second filaments and enclosing the base core, and a first sheath layer enclosing the intermediate layer. At least one of the first filament and the second filaments has a molded structure which includes a toothed core that is made of a first plastic material and that has a toothed outer surface, and a second sheath layer that is made of a second plastic material and that is molded over the toothed core. The first plastic material has a hardness and a wear-resistance less than those of the second plastic material.

12 Claims, 8 Drawing Sheets

STRING FOR A RACKET

CROSS-REFERENCE TO RELATED APPLICATION

This application is a continuation-in-part (CIP) of U.S. patent application Ser. No. 09/676,404, now U.S. Pat. No. 6,450,904 filed by the applicant on Sep. 29, 2000, the entire disclosure of which is incorporated herein by reference.

BACKGROUND OF THE INVENTION

1. Field of the Invention

This invention relates to a string for a sports racket, more particularly to a string having a toothed core and a sheath layer molded over the toothed core.

2. Description of the Related Art

A known type of conventional racket string is formed from a plurality of core filaments which are twisted together upon passing through an impregnating container carrying a thermoplastic resin therein for impregnating the filaments so as to increase the elasticity of the string. This type of string generally has poor wear-resistance. When the string is used in a racket, high impact and friction induced upon hitting a ball would result in severe wearing of the string.

Another conventional string is formed from a plurality of core filaments sheathed by a moisture-cured polyurethane which provides hardness to increase the wear-resistance of the string. However, this type of string has poor elasticity. Thus, reactive force produced in the string upon impact may injure the user's hand.

SUMMARY OF THE INVENTION

Therefore, it is an object of the present invention to provide a string for a sports racket that has a structure capable of providing good wear-resistance and elasticity.

Accordingly, a string for a racket of the present invention comprises: a base core formed from at least a first filament; an intermediate layer formed from a plurality of second filaments and enclosing the base core; and a first sheath layer enclosing the intermediate layer. At least one of the first filament and the second filaments has a molded structure which includes a toothed core that is made of a first plastic material and that has a toothed outer surface, and a second sheath layer that is made of a second plastic material and that is molded over the toothed core so as to be bonded to the toothed outer surface. The first plastic material has a hardness and a wear-resistance less than those of the second plastic material.

BRIEF DESCRIPTION OF THE DRAWINGS

In drawings which illustrate embodiments of the invention.

DETAILED DESCRIPTION OF THE PREFERRED EMBODIMENTS

Figure 1:
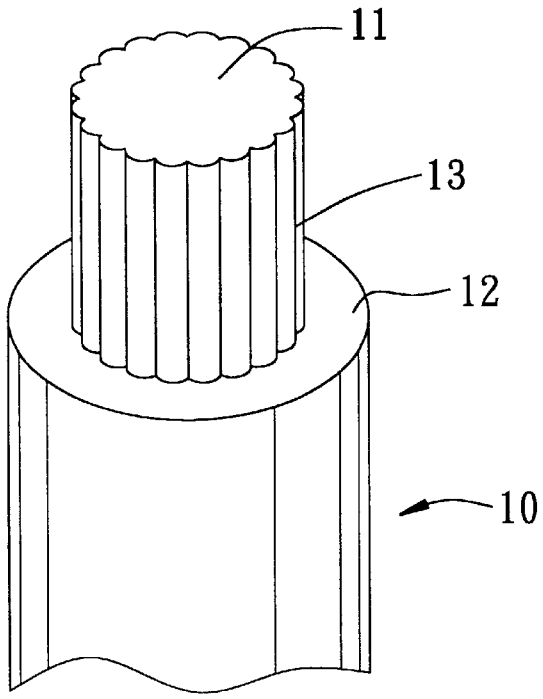
FIGS. 1 and 2 illustrate a molded structure of a filament of a string embodying this invention.
Figure 2:
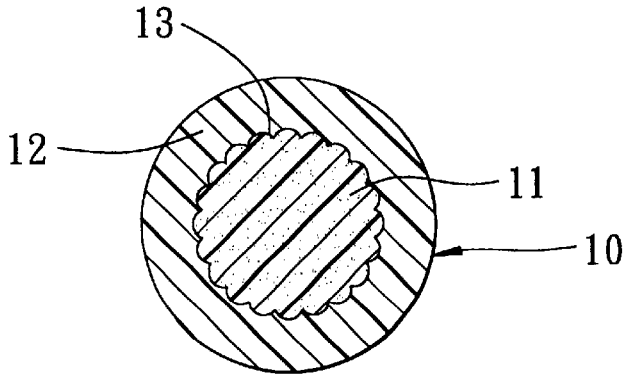
Figure 3:
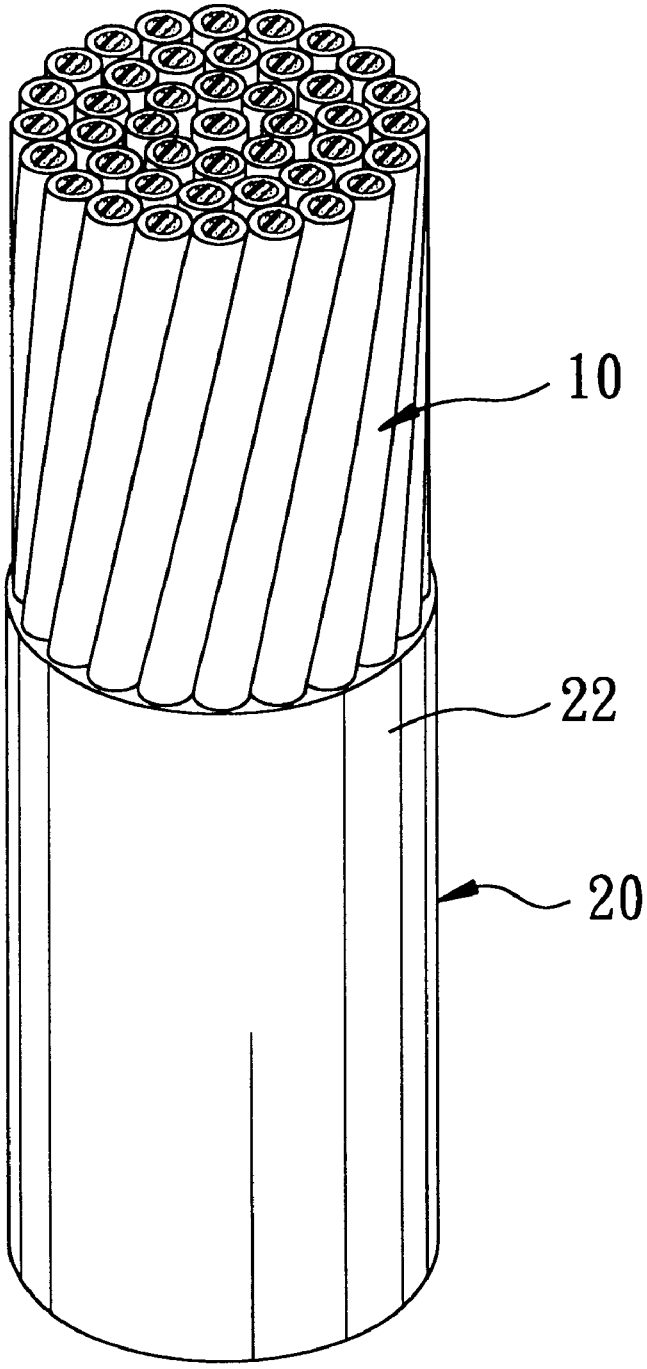
FIG. 3 is a perspective view illustrating a first embodiment of the string of this invention that includes a bundle of filaments, each of which has the molded structure of FIG. 1.

FIG. 3 illustrates a first embodiment of a string 20 according to this invention for a sports racket. The string 20 includes a first sheath layer 22 and a bundle of filaments 10, each of which has a molded structure as shown in FIGS. 1 and 2 and each of which includes a toothed core 11 that is made of a first plastic material and that has a toothed outer surface 13, and a second sheath layer 12 that is made of a second plastic material and that is molded over the toothed core 11 so as to be bonded to the toothed outer surface 13. The toothed outer surface 13 includes a plurality of rounded teeth so as to enhance the bonding between the second sheath layer 12 and the toothed core 11.

The first plastic material has a hardness and a wear-resistance less than those of the second plastic material. Preferably, the first plastic material is made of polyurethane or nylon, and the second plastic material is made of polyester.

The string 20 is preferably prepared by co-extruding the first and second plastic materials via an extruder (not shown).

Figure 9:
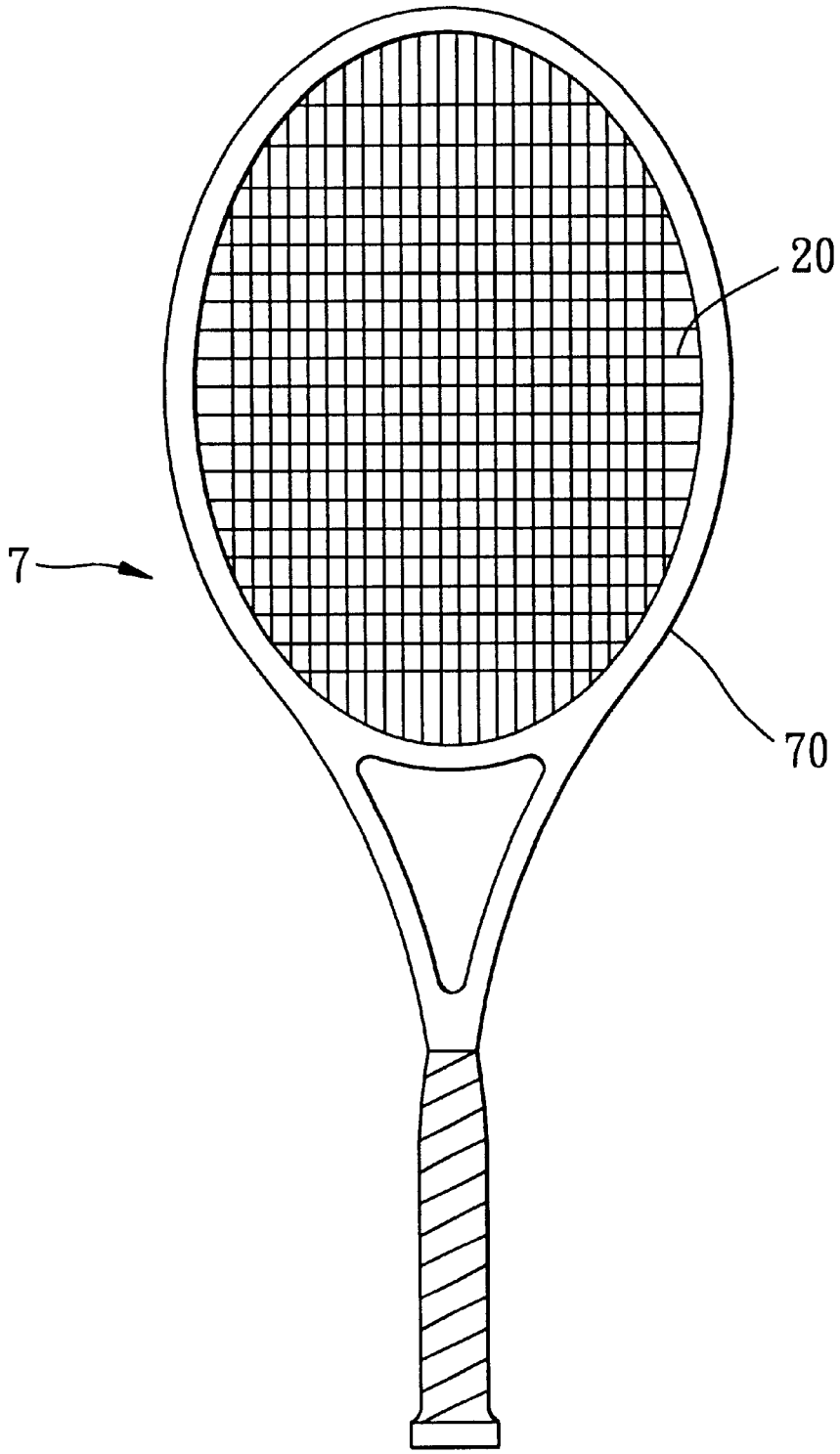
FIG. 9 illustrates a sports racket including a racket frame and a cord netting consisting of the string that embodies this invention.

The string 20 has a structure that is soft in the inside and hard on the outside which provides the string 20 with good elasticity and wear-resistance, thereby increasing the service life when used in a sports racket 7 (see FIG. 9). The sports racket 7 shown in FIG. 9 includes a racket frame 70 and a cord netting consisting of the string 20 and stretched in the frame 70.

Figure 4:
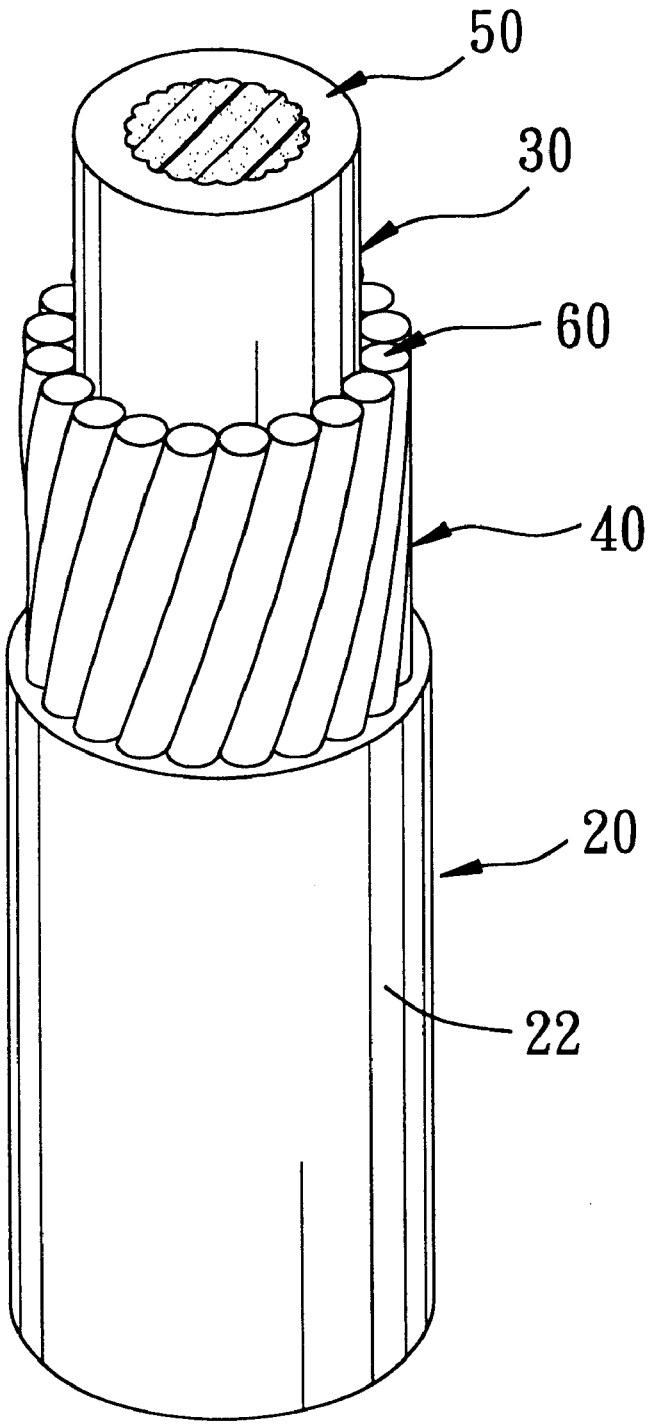
FIG. 4 is a perspective view illustrating a second embodiment of the string of this invention that includes a first filament which has the molded structure of FIG. 1, and a plurality of second filaments twisted about the first filament.

FIG. 4 illustrates a second embodiment of the string 20 that is modified from the first embodiment. In this embodiment, the string 20 includes a base core 30 that is formed from a first filament 50, an intermediate layer 40 that is formed from a plurality of second filaments 60 and that encloses the base core 30, and the first sheath layer 22 that encloses the intermediate layer 40. The second filaments 60 are disposed side by side in an annular row and are twisted about the first filament 50.

The first filament 50 has the same molded structure as the filament 10 of the first embodiment shown in FIG. 3, whereas each one of the second filaments 60 is made of a third plastic material that is selected from a group consisting of polyester, nylon, thermoplastic polyurethane, and polyaryletherketone.

Figure 5:
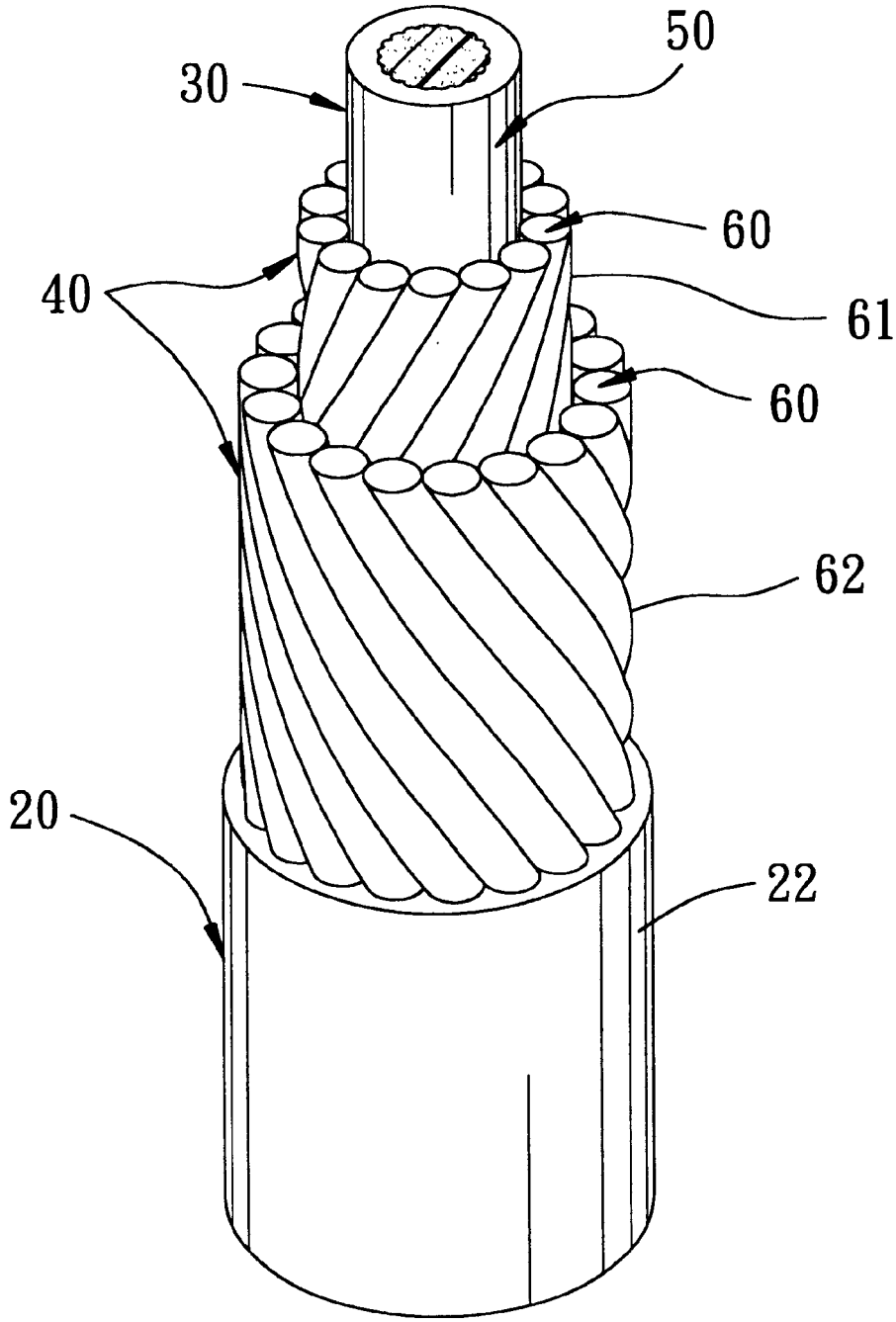
FIG. 5 is a perspective view illustrating a third embodiment of the string of this invention that includes a first set of the second filaments twisted about the first filament of FIG. 4 and a second set of the second filaments twisted about the first set of the second filaments.

FIG. 5 illustrates a third embodiment of the string 20 that is modified from the second embodiment. In this embodiment, the intermediate layer 40 of the string 20 includes a first set 61 of the second filaments 60 which are disposed side by side in a first annular row and which are twisted about the first filament 50 in a first direction, and a second set 62 of the second filaments 60 which are disposed side by side in a second annular row and which are twisted about the first set 61 of the second filaments 60 in a second direction that is opposite to the first direction.

Figure 6:
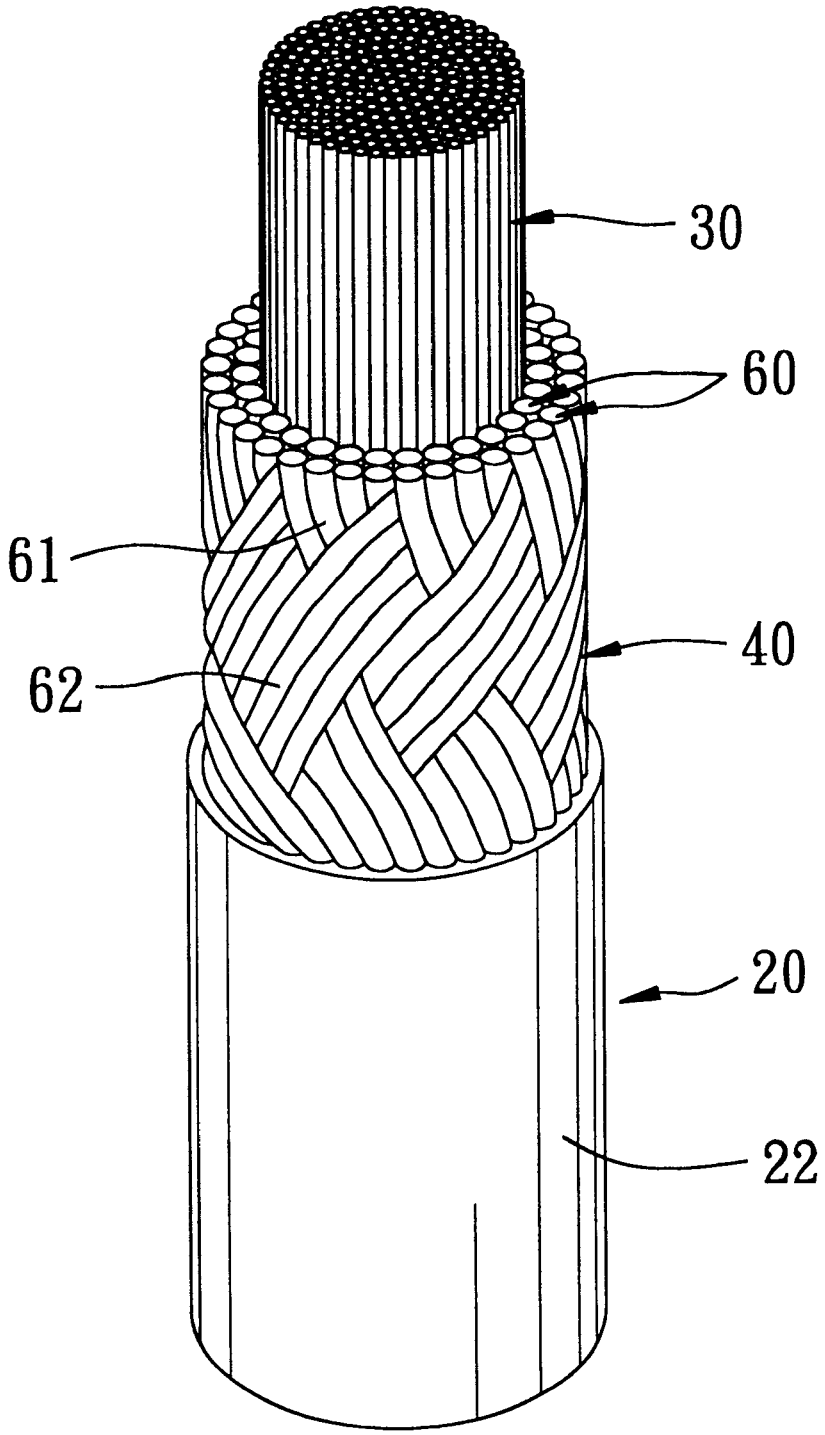
FIG. 6 is a perspective view illustrating a fourth embodiment of the string of this invention that includes a bundle of the first filaments of FIG. 4 and interlaced first and second sets of the second filaments twisted about the first filaments.

FIG. 6 illustrates a fourth embodiment of the string 20 that is also modified from the second embodiment. In this embodiment, the base core 30 of the string 20 is formed as a bundle of the first filaments 50, and the first and second sets 61, 62 of the second filaments 60 are interlaced, are disposed in annular rows surrounding the first filaments 50, and are twisted oppositely about the first filaments 50 in first and second directions.

Figure 7:
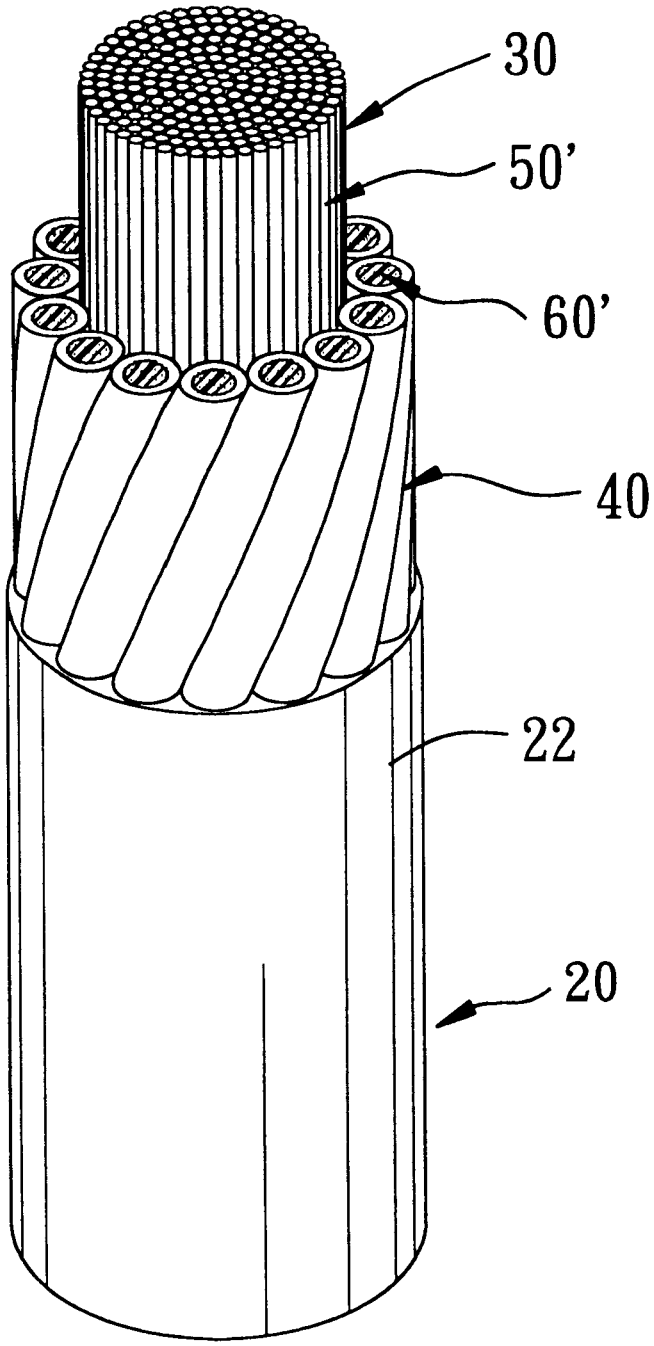
FIG. 7 is a perspective view illustrating a fifth embodiment of the string of this invention that includes a bundle of the first filaments and a plurality of the second filaments that are twisted about the first filaments and that have the molded structure of FIG. 1.

FIG. 7 illustrates a fifth embodiment of the string 20 that is modified from the first embodiment. In this embodiment, the base core 30 is formed as a bundle of first filaments 50', and a plurality of second filaments 60' disposed side by side in an annular row and twisted about the first filaments 50'. Each of the first filaments 50' is made of a third plastic material that is selected from a group consisting of polyester, nylon, thermoplastic polyurethane, and polyaryletherketone. Each of the second filaments 60' has the same molded structure of the filament 10 of the first embodiment shown in FIG. 1.

Figure 8:
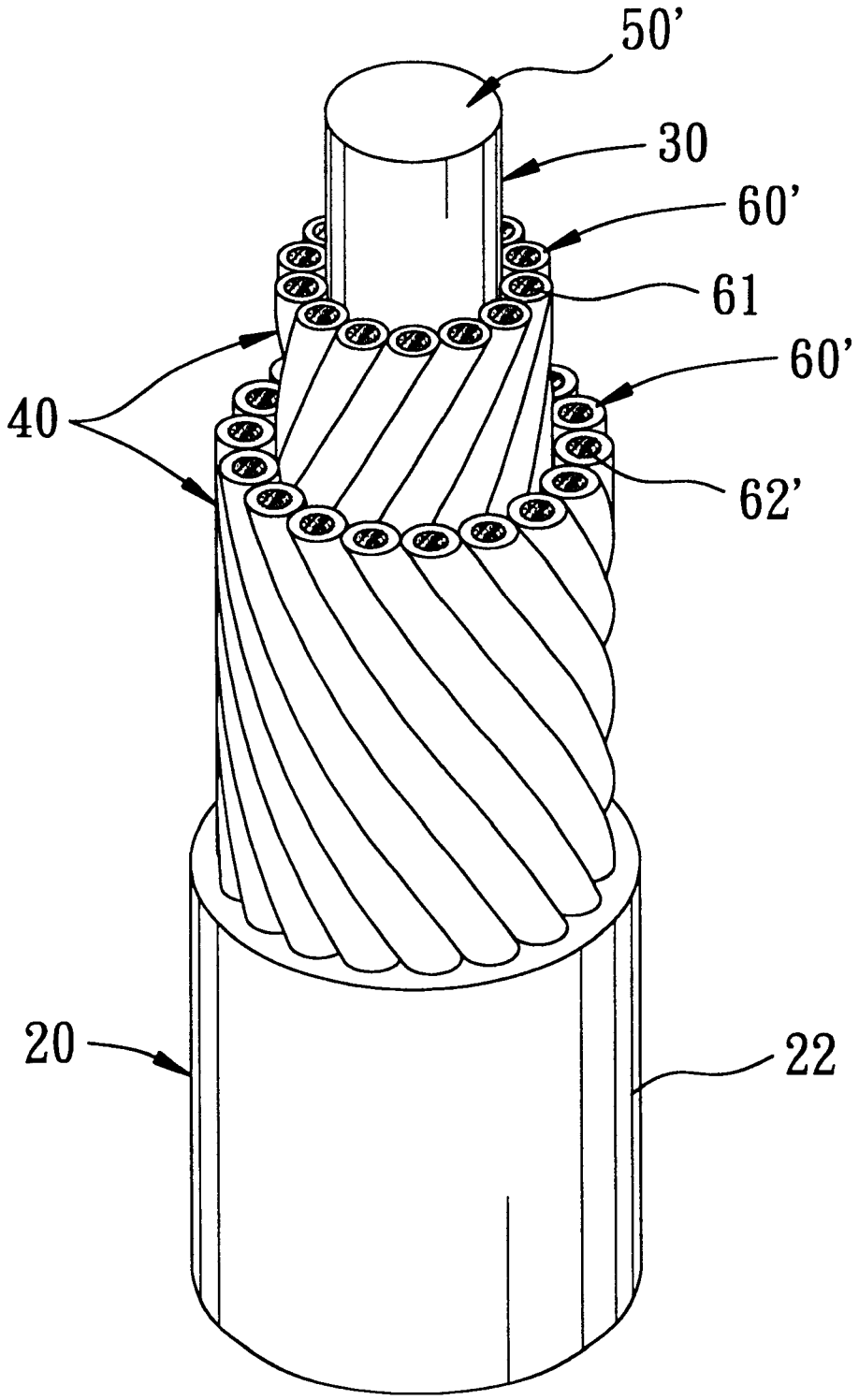
FIG. 8 is a perspective view illustrating a sixth embodiment of the string including a first set of second filaments that are twisted about a first filament, and a second set of the second filaments that are twisted about the first set of the second filaments, each of the second filaments having the molded structure of FIG. 1.

FIG. 8 illustrates a sixth embodiment of the string 20 that is modified from the fifth embodiment. In this embodiment, the base core 30 is formed from a single first filament 50', and the intermediate layer 40 includes a first set 61' of the second filaments 60' which are disposed side by side in a first annular row and which are twisted about the first filament 50' in a first direction, and a second set 62' of the second filaments 60' which are disposed side by side in a second annular row and which are twisted about the first set 61' of the second filaments 60' in a second direction that is opposite to the first direction.

With the invention thus explained, it is apparent that various modifications and variations can be made without departing from the spirit of the present invention. It is therefore intended that the invention be limited only as recited in the appended claims.

I claim:

1. A racket, comprising:

a racket frame; and a cord netting stretched in said frame;

said cord netting consisting of a string that is composed of: a base core formed as at least a first filament; an intermediate layer formed from a plurality of second filaments and enclosing said base core; and a first sheath layer enclosing said intermediate layer, at least one of said first filament and said second filaments having a molded structure which includes a toothed core that is made of a first plastic material and that has a toothed outer surface, and a second sheath layer that is made of a second plastic material and that is molded over said toothed core so as to be bonded to said toothed outer surface, said first plastic material having a hardness and a wear-resistance less than those of said second plastic material, wherein said first filament is in the form of said molded structure and each of said second filaments is made of a third plastic material that is selected from a group consisting of polyester, nylon, thermoplastic polyurethane, and polyaryletherketone, and wherein said base core is formed as a bundle of said first filaments, each of which is in the form of said molded structure, said intermediate layer including a first set of said second filaments which are twisted about said first filaments in a first direction, and a second set of said second filaments which are twisted about said first filaments in a second direction that is opposite to said first direction, said first and second sets of said second filaments being interlaced and being disposed in annular rows surrounding said first filaments.

2. The racket of claim 1, wherein said first and second plastic materials are co-extruded to form said toothed core and said second sheath layer.

3. The racket of claim 1, wherein said first plastic material is polyurethane.

4. The racket of claim 3, wherein said second plastic material is polyester.

5. The racket comprising:

a racket frame; and a cord netting stretched in said frame;

said cord netting consisting of a string that is composed of: a base core formed as at least a first filament; an intermediate layer formed from a plurality of second filaments and enclosing said base core; and a first sheath layer enclosing said intermediate layer, at least one of said first filament and said second filaments having a molded structure which includes a toothed core that is made of a first plastic material and that has a toothed outer surface, and a second sheath layer that is made of a second plastic material and that is molded over said toothed core so as to be bonded to said toothed outer surface, said first plastic material having a hardness and a wear-resistance less than those of said second plastic material, and wherein the toothed outer surface of the toothed core comprises teeth having a base width which is greater than a height of the teeth.

6. A string for a racket, comprising:

a base core formed from at least a first filament;

an intermediate layer formed from a plurality of second filaments and enclosing said base core; and a first sheath layer enclosing said intermediate layer;

at least one of said first filament and said second filaments having a molded structure which includes a toothed core that is made of a first plastic material and that has a toothed outer surface, and a second sheath layer that is made of a second plastic material and that is molded over said toothed core so as to be bonded to said toothed outer surface, said first plastic material having a hardness and a wear-resistance less than those of said second plastic material, wherein said first filament is in the form of said molded structure and each of said second filaments is made of a third plastic material that is selected from a group consisting of polyester, nylon, thermoplastic polyurethane, and polyaryletherketone, and wherein said base core is formed as a bundle of said first filaments, each of which is in the form of said molded structure, said intermediate layer including a first set of said second filaments which are twisted about said first filaments in a first direction, and a second set of said second filaments which are twisted about said first filaments in a second direction that is opposite to said first direction, said first and second sets of said second filaments being interlaced and being disposed in annular rows surrounding said first filaments.

7. The string of claim 6, wherein said first and second plastic materials are co-extruded to form said toothed core and said second sheath layer.

8. The string of claim 7, wherein said first plastic material is polyurethane.

9. The string of claim 8, wherein said second plastic material is polyester.

10. The string of claim 6, wherein said second filaments are disposed side by side in an annular row and are twisted about said first filament.

11. A string for a racket, comprising:

a base core formed from at least a first filament;

an intermediate layer formed from a plurality of second filaments and enclosing said base core; and a first sheath layer enclosing said intermediate layer;

at least one of said first filament and said second filaments having a molded structure which includes a toothed core that is made of a first plastic material and that has a toothed outer surface, and a second sheath layer that is made of a second plastic material and that is molded over said toothed core so as to be bonded to said toothed outer surface, said first plastic material having a hardness and a wear-resistance less than those of said second plastic material, and wherein the toothed outer surface of the toothed core comprises teeth having a base width which is greater than a height of the teeth.

12. A string for a racket, comprising:

a longitudinally extending core formed from at least a first filament;

an intermediate layer defined by a plurality of second filaments enclosing the longitudinally extending core; and a first sheath layer enclosing the intermediate layer;

wherein at least one of the first filament and the second filaments has a toothed core made of a first plastic material and having an outer surface formed by teeth each having a base width which is greater than a height of the tooth, and a second sheath layer made of a second plastic material and molded over the toothed core.

* * * * *